US007428873B1

(12) United States Patent
Searle et al.

(10) Patent No.: US 7,428,873 B1
(45) Date of Patent: Sep. 30, 2008

(54) SECURITY SYSTEM

(75) Inventors: Andrew Robin Searle, Lydford (GB); Geoffrey Keith Hill, Noss Mayo (GB)

(73) Assignee: Oberthur Cash PRotection, Paris (FR)

( * ) Notice: Subject to any disclaimer, the term of this patent is extended or adjusted under 35 U.S.C. 154(b) by 0 days.

(21) Appl. No.: 09/582,796

(22) PCT Filed: Dec. 22, 1998

(86) PCT No.: PCT/GB98/03882

§ 371 (c)(1),
(2), (4) Date: Aug. 23, 2000

(87) PCT Pub. No.: WO99/35622

PCT Pub. Date: Jul. 15, 1999

(30) Foreign Application Priority Data

Dec. 31, 1997 (GB) ..... 9727515.0

(51) Int. Cl.
*E05G 1/00* (2006.01)

(52) U.S. Cl. ..... 109/24; 109/25; 109/29; 109/30; 232/15; 340/5.33; 340/825.69; 340/825.72

(58) Field of Classification Search ..... 109/25, 109/29–34, 24, 24.1, 45, 47; 232/15, 16, 232/1 D; 340/5.9, 5.91, 5.92, 825.69, 825.72, 340/5.3, 5.33; 235/382
See application file for complete search history.

(56) References Cited

U.S. PATENT DOCUMENTS

| | | | | |
|---|---|---|---|---|
| 4,799,435 | A * | 1/1989 | Boutroy | 109/25 |
| 4,852,502 | A * | 8/1989 | Klingberg et al. | 109/25 |
| 5,598,793 | A | 2/1997 | Lopez, Jr. | 109/25 |
| 5,615,625 | A * | 4/1997 | Cassidy et al. | 109/45 |
| 5,626,039 | A * | 5/1997 | Solari et al. | 70/279.1 |
| 5,787,819 | A * | 8/1998 | Fumanelli | 109/38 |
| 6,065,408 | A * | 5/2000 | Tillim et al. | 109/25 |
| 6,191,690 | B1 * | 2/2001 | Mukogawa | 340/568.7 |

FOREIGN PATENT DOCUMENTS

| | | |
|---|---|---|
| DE | 3001214 | 7/1981 |
| DE | 4121492 | 1/1993 |
| DE | 4140451 | 6/1993 |
| GB | 2281998 | 3/1995 |

* cited by examiner

*Primary Examiner*—Lloyd A Gall
(74) *Attorney, Agent, or Firm*—Young & Thompson

(57) ABSTRACT

A security apparatus is provided for use in an automatic teller machine. The security apparatus (100) has a coupling arrangement (110, 150) for engaging the unit with a cash cassette used to hold money within an automatic teller machine and a spoiling system (130, 132) for delivering a spoiling agent for spoiling the contents of the cassette in response to a control signal issued by a controller.

18 Claims, 14 Drawing Sheets

SECURITY SYSTEM

SECURITY SYSTEM

The present invention relates to a security system. Such a security system is particularly suited for use in cash in transit operations such as where cash is delivered to automatic teller machines. The system also comprises improvements to the security of automatic teller machines.

BACKGROUND OF INVENTION

Automatic teller machines (ATM) are now common. Each machine carries a number of removable cassettes in which money is stored. Stamps or tickets may be stored in similar types of machines. It is necessary, from time to time, to replenish the cassettes in the ATM. This is normally done at fixed intervals based on the expected usage of the machine. A security vehicle and guards is dispatches from a central location to take full cassettes to an ATM. The cassettes may typically contain £200,000 and consequently theft of one or more cassettes represents a relatively easy way of obtaining a significant amount of money for a criminal. Furthermore, when a new cassette is installed in a machine, a "empty" cassette is removed from the machine. However, since the replenishment is done at predetermined intervals, rather than when the cassettes are low or empty, the "empty" cassettes may in fact contain a considerable amount of cash. Some £3.5 million was lost in 1995 in the UK alone through robberies on ATM machines when money was being transferred.

BRIEF SUMMARY OF INVENTION

According to a first aspect of the present invention, there is provided a security unit comprising locking means for locking the security unit onto a container to be protected, spoiling means for spoiling the contents of the container in the event of an attack and control means for controlling-operation of the locking means and spoiling means.

It is thus possible to provide a security unit which can lock onto a automatic teller cash cassette, or onto a cash cassette used for cash deliveries in general.

Advantageously, the locking means locks around an opening of the container, such as a cash cassette. Alternatively the locking means may engage with an adapter mounted on a side of the container or cassette.

The security unit may comprise a first module containing the control system thereof, and a second module containing the locking mechanism. The first and second modules are advantageously detachable from one another. The spoiling means may be included within one of the first and second modulates, for example the first module. Additionally or alternatively spoiling means may be included within the container protected by the security unit.

Preferably the control module includes communication means for exchanging data with other security devices. Advantageously the control module also includes a local memory and local power supply in order that it can function for a predetermined time without external electrical connection. The control module may also include a data processor and one or more sensors, such as motion sensors.

Advantageously, in use, the local memory is programmed with the identity of the or each automatic teller machine which is scheduled for a cash delivery within a predetermined time period, for example during a working day. The control unit may also include data concerning the expected time of delivery and data concerning the identity of other security systems associated with the ATM machines. Alternatively this data can be provided in respect of one delivery at a time by a controller in a delivery vehicle. Thus, as the security unit is removed from a cash in transit vehicle, the control unit may interface with a security system of the cash-in-transit vehicle to obtain an estimate of the vehicle's position and identity of the ATM to which a delivery is being made to. As the guard carries the cassette and security unit towards the ATM, the security unit may be arranged to establish a bi-directional communication link with the ATM in order that the security unit and the ATM can verify the identity of each other. Failure to obtain a valid identity within a predetermined period of time may be taken as an indication that a breach of security has been occurred and may cause the spoiling mechanism to be activated.

The ATM may be arranged, upon identification upon the expected security unit, to release some of its own security measures, such as unlocking a safe in which an ATM is normally located.

The control unit may also be arranged to interface with bank door locks or other security systems along it route from the cash-in-transit vehicle to the ATM in order to validate that the delivery is going to plan.

The control unit of the security unit may also measure parameters such as walk time, ie the time which it believes it is being carried by the guard, or absolute time or distance traveled and if any of these exceeds an associated threshold time, a security breach may be identified and the spoiling mechanism activated.

The control unit may also be used to deliver data to an ATM or other bank systems. For example, ATM's usually communicate with a central processing centre in order to validate card details before dispensing money. The processing centre then transmits instructions back to the ATM in encrypted form. The ATM needs a decryption key in order to decrypt the data. The control unit may be used to pass one or more decryption keys, together with details of the times (which includes days) on which the keys are to be used, to the ATM during the transfer of cassettes of money. The decryption key may be the private key of an asymmetric encryption-decryption system. The or each key may be passed in encrypted form to the ATM.

The control unit may also receive data from the ATM concerning the amount of cash left in the cassettes and/or the fault status of the ATM. This data may be encrypted by the control unit or the ATM for transfer to a cash handling centre. Thus reconciliation of the amount of cash returned with the "empty" cash cassettes is simplified.

The security unit may also include accelerometers, compasses and/or inertial guidance systems. These may be used to determine if the security unit is being carried in an inappropriate direction. Furthermore, the characteristic walk of a security guard may be learned over a period of time and this may be compared with the motion of the person carrying the security unit and cash cassette during a delivery in order to determine that the cash is being carried by an authorised person.

The security unit may include other environmental sensors, such as a temperature sensor. The temperature and/or rate of change of temperature may be monitored to determine if an attack is being made. It is known that oxyacetylene torches have been used in an attempt to cut off security units. Furthermore, some attempts have been made to defeat electronic based security systems by immersing the electronics in liquid nitrogen. Both of these techniques will involve a rapid rate of change of temperature which may be detected in order to activate the spoiling means. However, the rate of change of temperature may also be compared with actual temperature in order to inhibit operation of the spoiling means until the temperature falls outside of an expected range. Rapid changes in temperature may occur, for example, when a delivery is made from a security van operating in winter. Thus a very rapid change of temperature may be observed when the security unit is removed from the van.

The spoiling mechanism may include a dye pack for delivering the dye. The delivery means may comprise a gas cylinder, use of a chemical delivery system in order to generate gas to force the dye to be expelled, an explosive delivery system or a mechanical delivery system, for example in the form of a compression spring held in a compressed state until deployment is required. Multiple dye packs may also be provided.

Preferably the mechanical locking is provided by an interface element.

The spoiling unit may store multi-part spoiling components in isolated containment regions such that, during ejection, the at least two components become mixed in order to become activated to spoil the cash. Thus dyes and/or foaming agents and/or resins/glues may be delivered to stain the cash, to stick notes together, to embed them in a solid block or otherwise spoil the money (or other protected items).

Alternatively, the spoiling mechanism may include some other spoiling mechanism, such as a pyrotechnic smoke and/or dye device.

According to a second aspect of the present invention, there is provided a security container comprising:

1. An enclosure for defining a protected volume, said enclosure having an opening;
2. A removable closure for sealing the opening in the enclosure; and
3. A protective element protecting the removable closure from attack and arranged, in use, to act as a sacrificial element in the event of an attack on the security container in order to enable a spoiling apparatus located in one of the enclosure, the removable closure or the protective element to operate.

Preferably the removable closure is formed by an interface element.

Preferably the removable closure is arranged to selectively lock to one or more of the following:

1. A container;
2. The enclosure;
3. The protective element; and
4. An external locking apparatus.

Preferably the container is the cash cassette of the ATM, the cassette is placed inside the enclosure, and the interface element locks to the cash cassette and the enclosure.

The protective element may be in the form of a hood which, in use, covers the interface card and extends some way along the length of the enclosure. The interface card is also arranged to lock to the hood. It has been known for a guard to be attacked and the ATM cassette and an associated spoiling system to be removed from the guard. Thieves have then used a sledgehammer to knock the spoiling system from the cassette. If performed correctly, the spoiling system can be sheared away from the cassette before the spoiling system has had ample opportunity to spoil the contents. The provision of a sacrificial element, for example in the form of a casing or hood, means that such impulsive blows result in the deformation of the sacrificial element, whilst leaving the spoiling system intact for long enough to operate.

Preferably the enclosure and/or the protective element, ie hood, includes means for detecting physical penetration thereof. The penetration detecting means may include one or more conductors arranged, for example, such that one or more of them is broken by the formation of an aperture in the material of the enclosure or protective element. The conductors may, for example, be arranged in a serpentine or a helical manner. Additionally or alternatively, other physical: parameters such as change in conductivity, change in capacitance, pressure or optical propagation may also be utilised.

According to the third aspect of the present invention, there is provided a removable closure for a security container, the closure comprising locking means for locking to at least one of the following:

1. A container which encloses a volume to be protected;
2. An enclosure for protecting a volume to be protected, which volume may enclose the container mentioned herein above;
3. A protective cover; and, optionally,
4. An external locking apparatus.

Advantageously such a locking means is provided as an interface card carrying a plurality of movable engagement elements moveable between locking and unlocking positions. Preferably the engagement elements are slidable bolts. The bolts may be individually controllable or they may be constrained to operate in a predetermined sequence. The engagement elements may be controlled by associated actuators, for example solenoids. However, in a preferred embodiment the operation of the engagement elements are controlled by respective cams mounted for rotation in response to rotation of a common shaft. Advantageously, the cams are mounted for rotation about a common axis.

The, or selected ones, of the engagement elements may be arranged to extend proud of the container or cover in order to engage with the external locking apparatus.

Preferably the locking mechanism follows a set sequence and in turns locks onto other parts of the system as follows:

Position 1. All rods withdrawn;

Position 2. Locks onto a control unit only;

Position 3. Locks onto the control unit and cassette;

Position 4. Locks onto the control unit, cassette and sleeve;

Position 5. Locks onto the control unit, cassette, sleeve and rack of a cash-in-transit vehicle;

Position 6. Locks onto the cassette, sleeve and rack of the cash in transit vehicle.

The interface card is arranged that it can only proceed from one position to an adjacent position at a time. Advantageously the protective element, for example the sacrificial hood, is also locked onto the locking mechanism at the positions 2, 3, 4 and 5.

Advantageously the control unit includes means for driving the interface card between it's various operating positions. The control unit may also include the spoiling means and it's activation system. The control means may be held within the protective element.

Preferably the shaft is an input shaft of the interface card and is protected from malicious or inadvertent rotation by an electromechanical interlock. Preferably the interlock is in the form of a solenoid which must be actuated to release the input shaft in order to allow it to rotate.

Advantageously solenoid is powered by an inductive coupling. Thus there is no visually apparent means of supplying power to the solenoid, and indeed the solenoid is itself not visible from casual inspection of the interface card.

Alternatively, the shaft may be connected to or be part of an electric motor which may be wholly or partially implemented within the interface card. Where the motor is wholly implemented within the interface card, it may receive power from the control unit via an inductive coupling or by direct connection utilising contacts on the surface of the interface card. The interface card may also contain a motor controller which requires an identity code to be presented to it before it enables the motor. Where the motor is only partially implemented within the interface card, the rotor and rotor magnets may, for example, be inside the interface card whereas the stator coils may be in the control unit.

According to a fourth aspect of the present invention, there is provided a security device for use inside an automatic teller machine, the security device comprising coupling means for engaging the unit with ATM cash cassette, spoiling means for spoiling the contents of the cassette, and control means.

Advantageously the control means is arranged to establish communication with the ATM in order that an attack on the ATM may be signalled to the security device in order that it operates the spoiling means to spoil the contents of the cassette. The control means is preferably implemented as an electronic unit. The control means may be permanently attached to the ATM.

Preferably the security device is arranged to signal to the ATM when it has correctly coupled to the cassette and has taken over responsibility for protecting the money within the cassette. Advantageously a security system used to protect the money-during transport to the ATM will not disengage from the cassette until such time as the ATM based security system has confirmed that it is now responsible for security.

Preferably the ATM based security system comprises a reservoir of ink or other spoiling medium which can be ejected under pressure via a coupling unit into the cassette to degrade the contents thereof. The reservoir and control electronics of the ATM based security system may be contained within an enclosure containing penetration detection means, for example of the type herein before described, in order to prevent the electronics from being tampered with. The enclosure may also be penetration resistant for a period of time long enough to operate the spoiling means.

Preferably the ATM based security system informs the ATM prior to operating the spoiling mechanism, that the spoiling mechanism is going to be operated. This enables the ATM to undertake steps to minimise the collateral damage that will occur to itself. For example the ATM may close down it's mechanism that picks notes from the cassette, and may even close the cassette itself. These precautions can reduce the time required to re-establish normal operation of the ATM following attack.

According to a fifth aspect of the present invention, there is provided a tamper resistant coupling for coupling a ink or dye based security spoiling system to a security container, the coupling comprising co-operating male and female connectors, in which the male connector comprises a hollow pipe disposed within a relatively moveable sheath, the pipe including at least one delivery aperture arranged to one side thereof, such that as the male and female components are coupled together, the pipe extends into a recess in the female component and the end of the pipe extends past the or at least one delivery aperture in the female component.

It is thus possible to provide a coupling arrangement in which the male component is able to push debris past a delivery aperture in the female component, thus attempts to defeat the security system by placing chewing gum or the like in the dye delivery path are defeated.

Preferably a coupling monitoring device is arranged to monitor the relative motion between the sheath and the pipe of the male unit and to signal an error if the relative motion falls outside an expected range. Thus the coupling monitoring device is able to detect when the coupling is not properly coupled and to send a signal to the ATM security system, which in turn inhibits the security system used in transit of the cash from releasing from the cassette.

Advantageously, once the male and female units are properly coupled, a latch is operated to secure the units in place.

The latch or other latch acting exclusively on the cash cassette may include cash cassette location means to hold the cash cassette in a first position which corresponds to the operating position of the cassette within the ATM. The latch may also allow movement of the cassette, upon the application of a force, to a second position whereby this movement is detected by a position sensor and used to activate the spoiling mechanism which is still in fluid flow communication with the interior of the cassette. The latch may have a sacrificial element which is damaged or destroyed as the cassette moves from the first position to the second position. The second position corresponds to a position through which the cassette would be moved during an attempt to remove it from the ATM during a theft.

According to sixth aspect of the present invention, there is provided a rack system for use in a cash in transit vehicle, the rack containing a plurality of attachment points for attaching a cassette and interface card to the rack, and a control system for controlling spoiling means for spoiling the contents of the cassette, wherein the spoiling means may be provided within the rack or may be attached to or provided in the individual interface cards.

Advantageously the rack comprises a plurality of arms moveable between operating and non-operating positions. In the operating position, the arms are arranged to engage with and secure onto a cash cassette, whereas in the non-operating positions, the arms are folded away such that the vehicle may be used to carry other items.

Advantageously the rack includes a data communications link such that the security system used with the cassette while it is being carried can exchange data with the cash-in-transit vehicle in order to determine the position of the vehicle or other information such as the identity of the ATM machine which is to be filled, security codes or other relevant data.

It is advantageous for a dummy run to be made between the cash in transit vehicle and the ATM machine in order to ensure that the route is clear for use. The vehicle security system may be arranged to only release one in transit security system and a dummy container when the vehicle arrives at the unloading point. The security system used on the dummy run may interface with the ATM in order to verify its identity and may relay this information back to the vehicle security system when the dummy run is completed. The vehicle security system may be arranged to inhibit release of the cassettes until such time as the dummy run has been completed and the identity of the ATM to be loaded has been confirmed to the vehicle's security system. Furthermore, the in-transit security system used in the dummy run may compare the time of the dummy run with an expected time and only assert that the dummy run was made without incident if the actual time and expected time are within a predetermined time range of one another. Alternatively, the time of the dummy run may be used to vary the time allotted to the actual delivery. This enables the walk time to be corrected in the event that the delivery vehicle has to park at a different position than expected, for example due to a change in parking restrictions or other traffic.

The system also makes it possible to use a single operator with a cash-in-transit vehicle rather than the multiple guards as is currently the case. In known cash-in-transit vehicles one operator is located inside the vault of the vehicle and passes cash for delivery through an airlock to the guard who walks between the vehicle and the bank. The reason for adopting this system is that, apart from the fact that it is difficult to penetrate the vault, the vehicle provides no other protection for the cash, and in particular does not include a spoiling system. By utilising the present invention the vehicle's security system can protect cash in an unattended vehicle. Furthermore the vehicle's security system can send an alarm signal to the base in the event that an attack is made on the vehicle or that the guard does not return to the vehicle within an allowed time period. Thus, such a system opens the possibility of using vehicles staffed only by a single guard.

According to a seventh aspect of the present invention, there is provided an ATM machine arranged to exchange data with the security systems herein before described.

The ATM and the security system may be arranged to pass security/identity codes, data concerning the value of money in a new cash cassette value of money remaining in an old cassette, and encryption/decryption keys. This data may be encrypted.

According to an eighth aspect of the present invention, there is provided a marker for use in a spoiling apparatus, the marker comprising an ink or dye having or including an additive that emits visible radiation.

Preferably the ink, dye or additive is arranged to Phosphoresce or fluoresce. Suitable compounds exhibiting these properties are well known. Such a dye has the advantage that even if someone who touched the contents of the protected area, ie the cash cassette, after the spoiling mechanism had been operated, managed to wash the visible components from their hand, the fluorescing component may still remain on their skin and be revealed by illumination with ultraviolet light.

According to a ninth aspect of the present invention, there is provided an apparatus for activating a spoiling mechanism, comprising a first coil connected to energize the spoiling mechanism, the first coil being mounted on a first member and a second coil connected to a power supply and mounted on a second members in which the first and second members are arranged such that relative motion between them causes the coils to approach and inductively couple one another, thereby supplying power to the spoiling mechanism.

According to a tenth aspect of the present invention, there is provided a method of manufacturing tamper resistant panels or containers, comprising the steps of:

1. Laying down a first layer of fibres;

2. Laying down an array of sensing elements;

3. Laying down a second layer of fibres;

4. Optionally placing the layers into a mould;

5. Impregnating the layers with resin and allowing the resin to harden.

Advantageously the sensing elements are conductive.

The sensing elements may be in the form of an elongate conductor traversing a surface, for example in a series of parallel lines, where adjacent lines are connected to a neighbour, such that damage to the conductor renders the conductor non-conducting. The sensing elements may be supported by a support element, for example a plastics sheet.

Apertures may be provided, in alignment, in the first and second layers so as to leave portions of the sensing element exposed. This enables the panel/container to be used in blast detection since the pressure wave from an explosion can damage the sensing element. According to an eleventh aspect of the present invention, there is provided a method of protecting the contents of an ATM while the ATM is being serviced or repaired comprising the steps of securing the cash cassettes of an ATM to a security system according to the first or second aspect of the present invention, and removing the cash cassettes whilst the machine is being serviced or repaired.

According to a twelfth aspect of the present invention, there is provided a blast detector for detecting explosions, comprising a resilient element held in a first bowed state within an enclosure, with a first side of the element being exposed to impinging pressure waves such that, in response to a pressure wave exceeding a predetermined magnitude the element assumes a second bowed state which is detected to signal the occurrence of a blast.

Preferably, in the second bowed state, the resilient element operates a switch or abuts at least one electrical contact so as to complete a circuit. The circuit may be a detonator circuit for operating a spoiling arrangement for spoiling cash or other valuables within a protected area.

According to a twelfth aspect of the present invention, there is provided a delivery apparatus for a multi-component spoiling system, comprising at least first and second compartments separated by separation means and mixing means arranged to allow the contents of the compartments to mix in response to an increase in pressure on at least one of the compartments.

The at least two compartments may be collapsible reservoirs arranged to expel their contents via a common delivery path. The compartments may have frangible regions or pressure actuated valves which allow the content to be released when pressure in excess of a threshold is exerted on the reservoirs.

Alternatively, two or more compartments may be arranged in series such that an increase in pressure within an Nth (for example, first) compartment above a threshold opens a fluid flow communication path with an N+1th (for example second) compartment, the final compartment being arranged to deliver the mixture of components via a delivery aperture which is arranged to open in response to pressure exceeding a predetermined threshold.

Preferably the pressure is provided by a compressed gas held within a reservoir. The gas may be allowed to escape by virtue of an explosive change being activated to rupture a closure of the reservoir.

The gas reservoir may be wholly contained within the first compartment, or may be in fluid flow communication with it.

BRIEF DESCRIPTION OF DRAWINGS

The present invention will further be described, by way of example, with reference to the accompanying drawings, in which.

DETAILED DESCRIPTION

Figure 1:
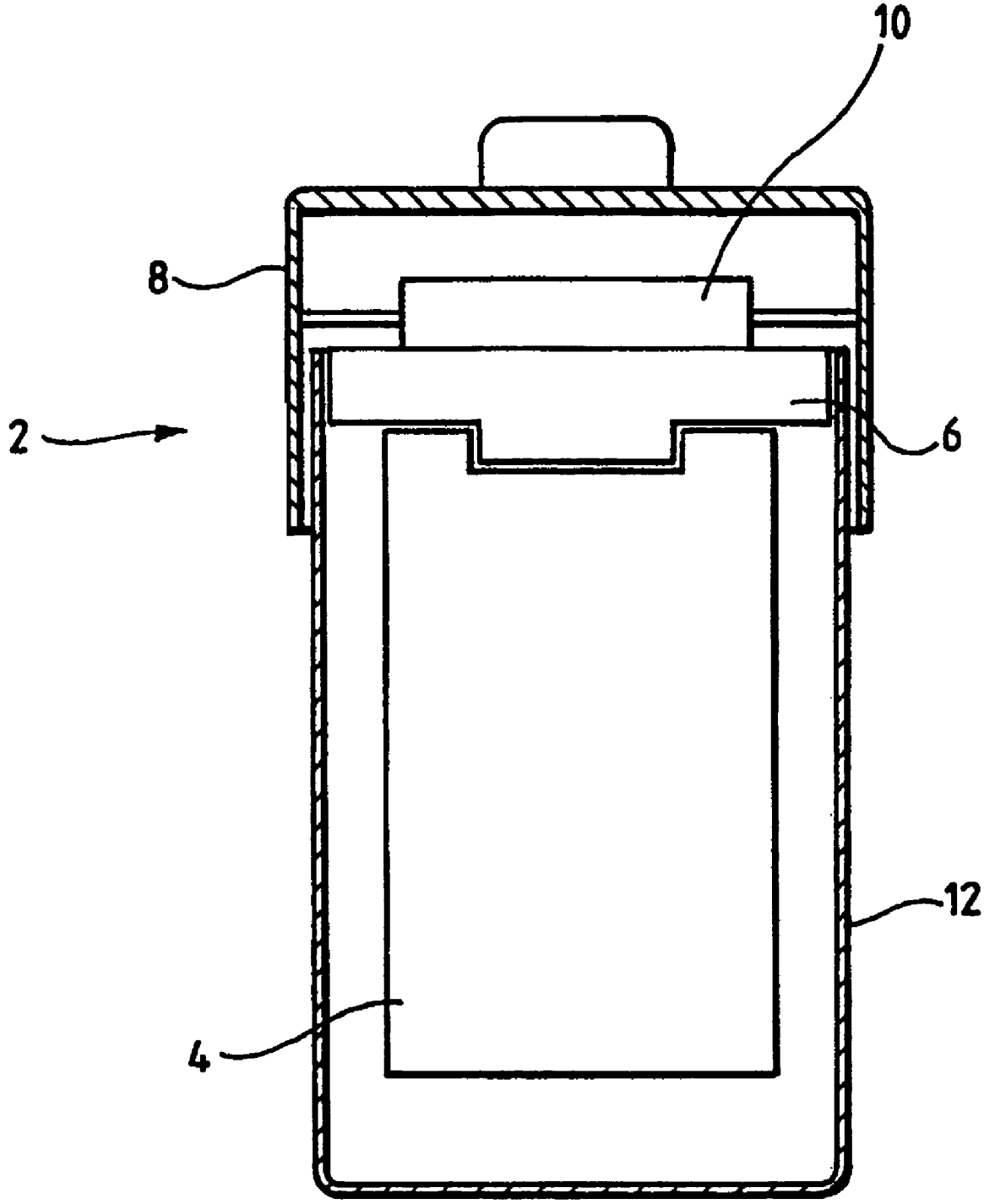
FIG. 1 schematically illustrates a security container constituting an embodiment of the first, second and third aspects of the present invention.

FIG. 1 schematically shows a cash-in-transit security container in cross section. The container, generally indicated as 2, provides protection against theft while the cash is being carried from a delivery vehicle to an automatic teller machine. This has traditionally been the weakest point in a security system, since the guard may be physically attacked in order to render him incapable, and the security container may be removed from the guard. An ATM cash cassette 4 is locked to an interface card 6 which contains a plurality of locking components in order to enable it to lock to various other components of the system. A hood 8 is also locked to the interface card 6 and carries an internal module 10 which incorporates a spoiling apparatus and processing electronics. An enclosure (also referred to herein as a sleeve) 12 surrounds the cash cassette 4 and extends within a lower lip of the hood 8, thereby completely enclosing the cash cassette 4 and the interface card 6. The hood 8 and the enclosure 12 are each manufactured so as to include a plurality, typically two, elongate conductive elements which repeatedly traverse the surface or interior of the hood and container in order that a breach in the walls of the hood or container will cause the conductive elements to be broken. This loss of conductivity can be used by the processing electronics within the module 10 as an indication that an attack upon the cash carrying container 2 is in progress.

Figure 2:
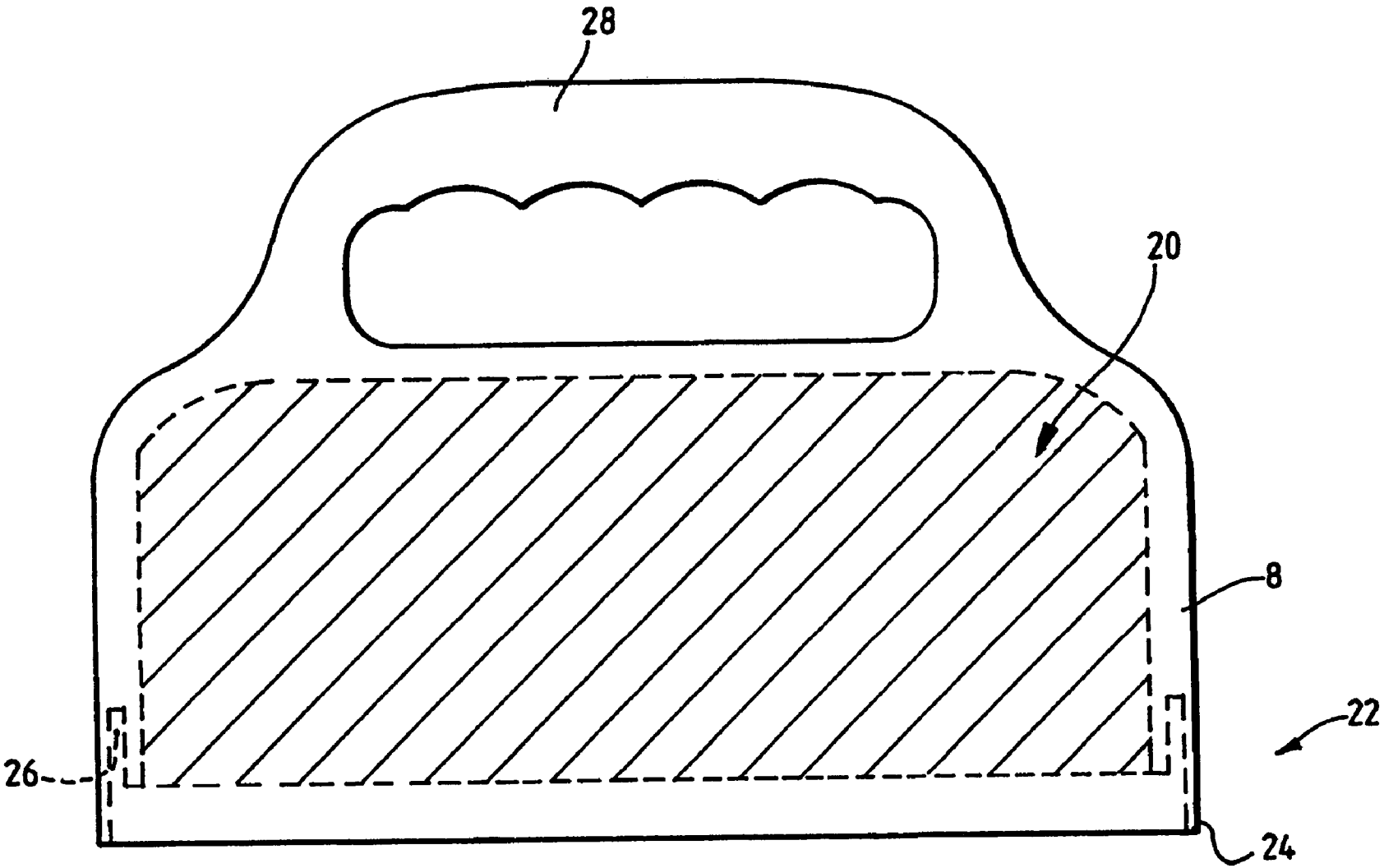
FIG. 2 schematically illustrates the sacrificial hood in greater detail.

FIG. 2 schematically illustrates the hood 8 in more detail. The hood 8 is of a unitary moulded construction and it contains an internal recess 20 in which the control electronics and spoiling mechanism are housed. The lower peripheral edge 22 of the hood 8 comprises a downwardly depending flange 24 which, in use, extends over the top of the sleeve 12, together with an internal recess 26 into which the uppermost portion of the sleeve 12 sits. Such an arrangement inhibits relative motion between the hood 8 and the sleeve 12. The hood also has an integrally moulded carrying handle 28. The inner surface of the hood 8 has a plurality of recesses which, in use, engage with reciprocating bolts of the interface card.

Figure 3:
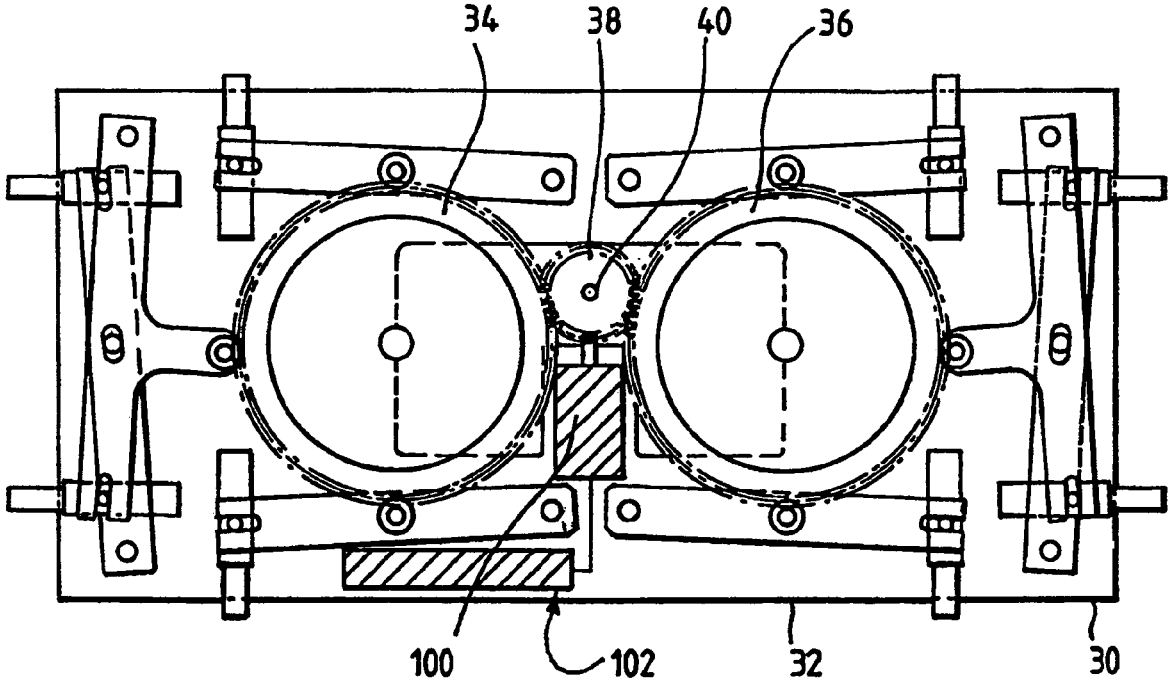
FIG. 3 is a schematic view of an interface card.

FIGS. 3 to 9 illustrate an interface card and the operation thereof. The interface card 30 illustrated in FIG. 3 is shown in a simplified form. The interface card comprises a base plate 32 which carries first and second gear wheels 34 and 36 in toothed engagement with a gear 38 held on an input shaft 40. Each of the gears 34 and 36 carries a plurality of camming surfaces. The camming surfaces may be vertically spaced from one another and/or may comprise one or more grooves formed in the respective cogs (gear wheels), or camming members attached thereto. Cam followers engage with the camming surfaces and the motion of the cam followers is transmitted via rods to cause displacement of locking pins, and will now be described in greater detail. The interface card 30 is provided with side walls and upper and lower plates so that the operating mechanism is protected and concealed from view.

Figure 4:
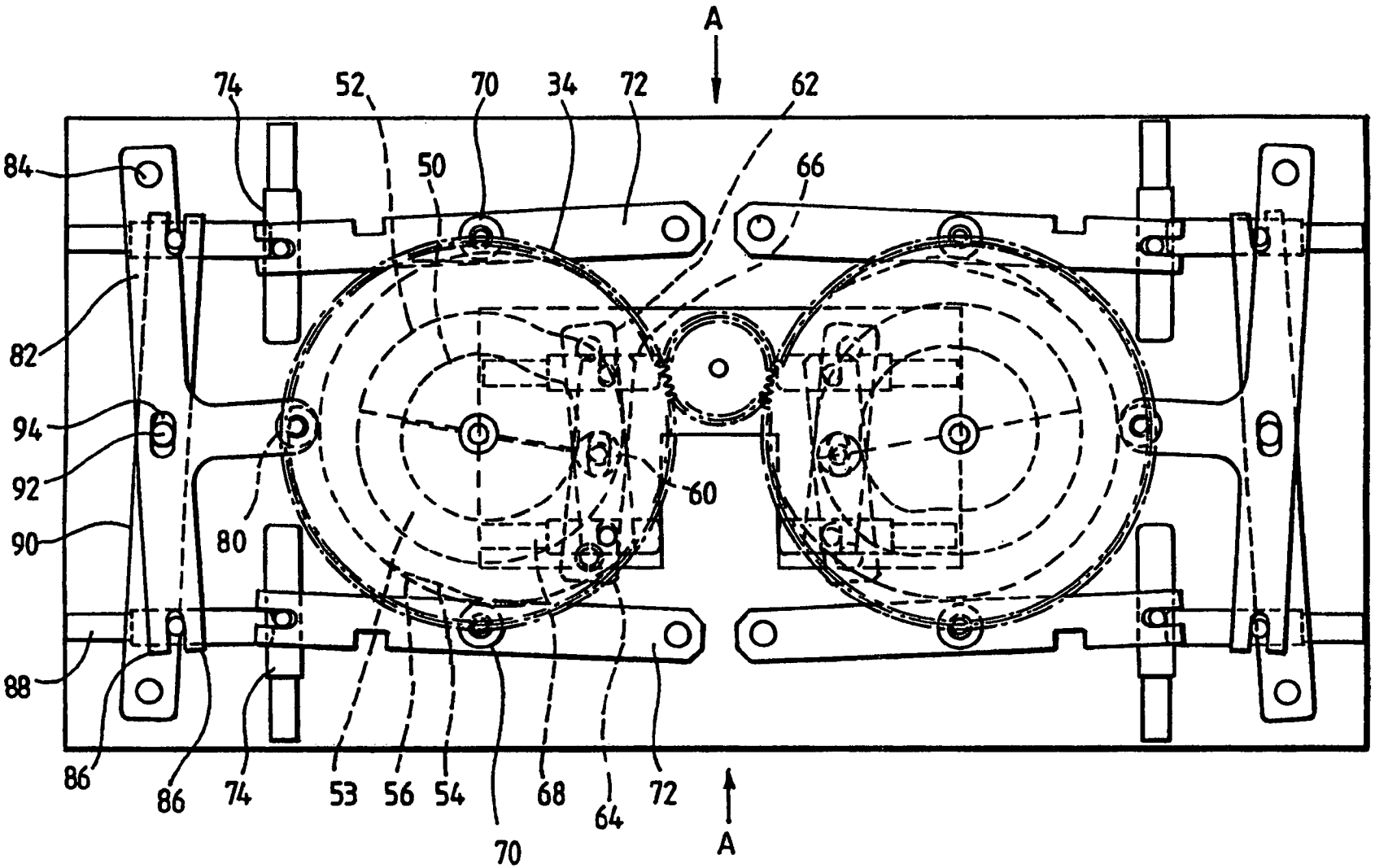
FIG. 4 illustrates an interface card at its birth position.

FIG. 4 shows the interface card in greater detail and also shows the outline of hidden elements. The card is symmetrical about the line A-A, and for simplicity only one half of the card will be described. The gear wheel 34 carries first to fourth spaced canning surfaces 50, 52, 54 and 56, respectively. The first and second camming surfaces form the sides of a groove 53. A first cam follower 60 engages camming surfaces 50 and 52 and also extends through aligned slots centrally disposed in a pair of pivotally mounted arms 62 and 64, the free ends of which engage with laterally extending projections of first and second slidable bolts 66 and 68, respectively. Rotation of the camming surfaces with the wheel 34 causes the bolts 66 and 68 to be extended or retracted from a downwardly depending base unit of the interface card so as to engage or disengage with attachment regions of a cash cassette.

Similarly, the cam followers 70 engaging respective ones of camming surfaces 54 and 56 (which are mirror images of each other). The camming surfaces 54 and 56 are vertically separated from one another (assuming the plane of FIG. 4 to be horizontal). The cam followers 70 are disposed midway along associated levers 72. Each lever 72 is pivoted at one end and has a free end which includes a notch for engaging a projecting pin of an associated bolt 74. Similarly, a further cam follower 80 is connected to a pivoted arm 82. The arm 82 is pivoted at a pivot point 84 at one end thereof, and has tines 86 formed at the other end thereof for engaging a pin of a reciprocating bolt 88. A similarly arranged pivoted arm 90 has an upstanding pin 92 which engages in a elongate slot 94 of the arm 82 such that motion of the arm 82 is transferred to the arm 90 to operate an associated bolt.

Figure 5:
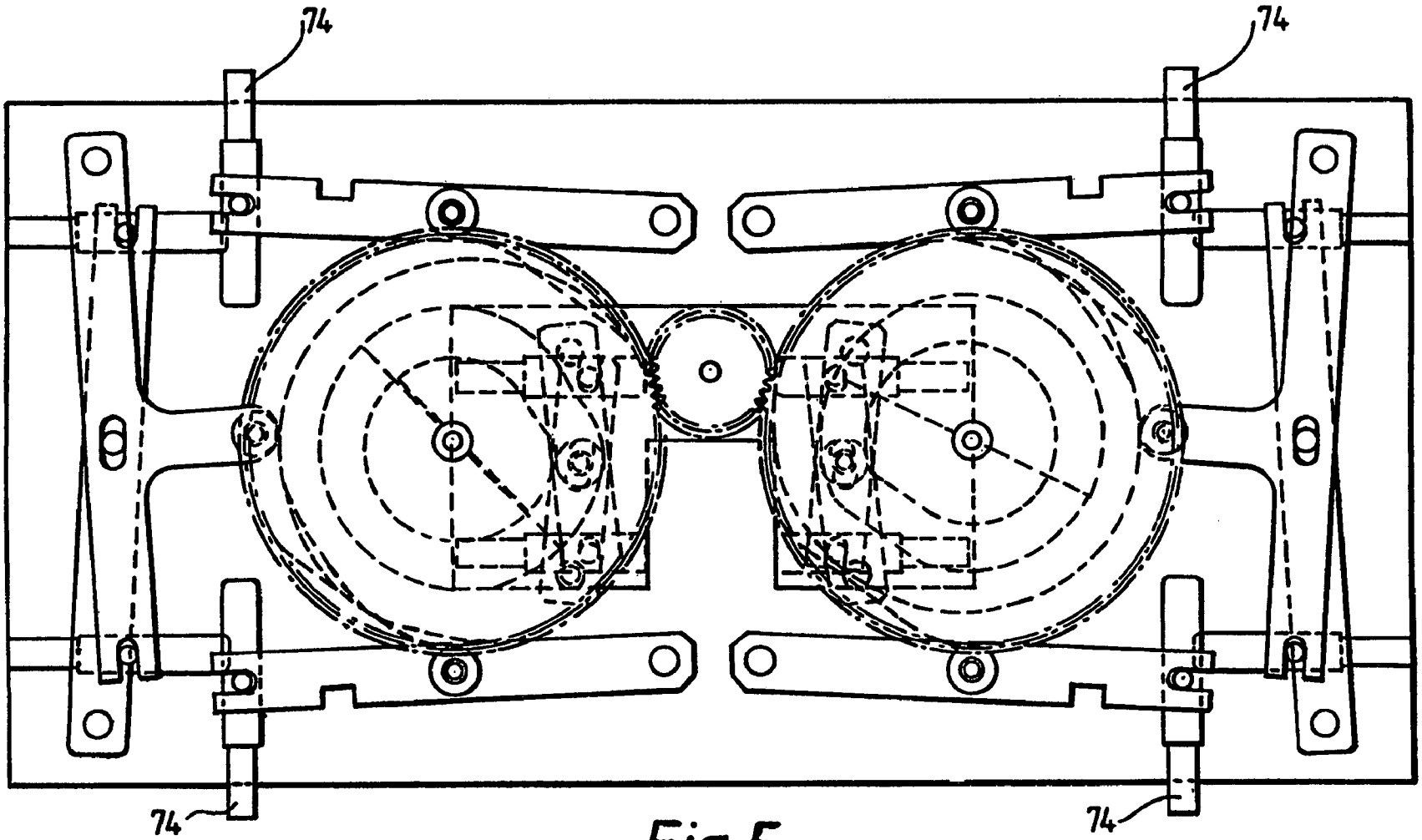
FIG. 5 illustrates the interface card of FIG. 4 at a position where it locks onto a hood.
Figure 6:
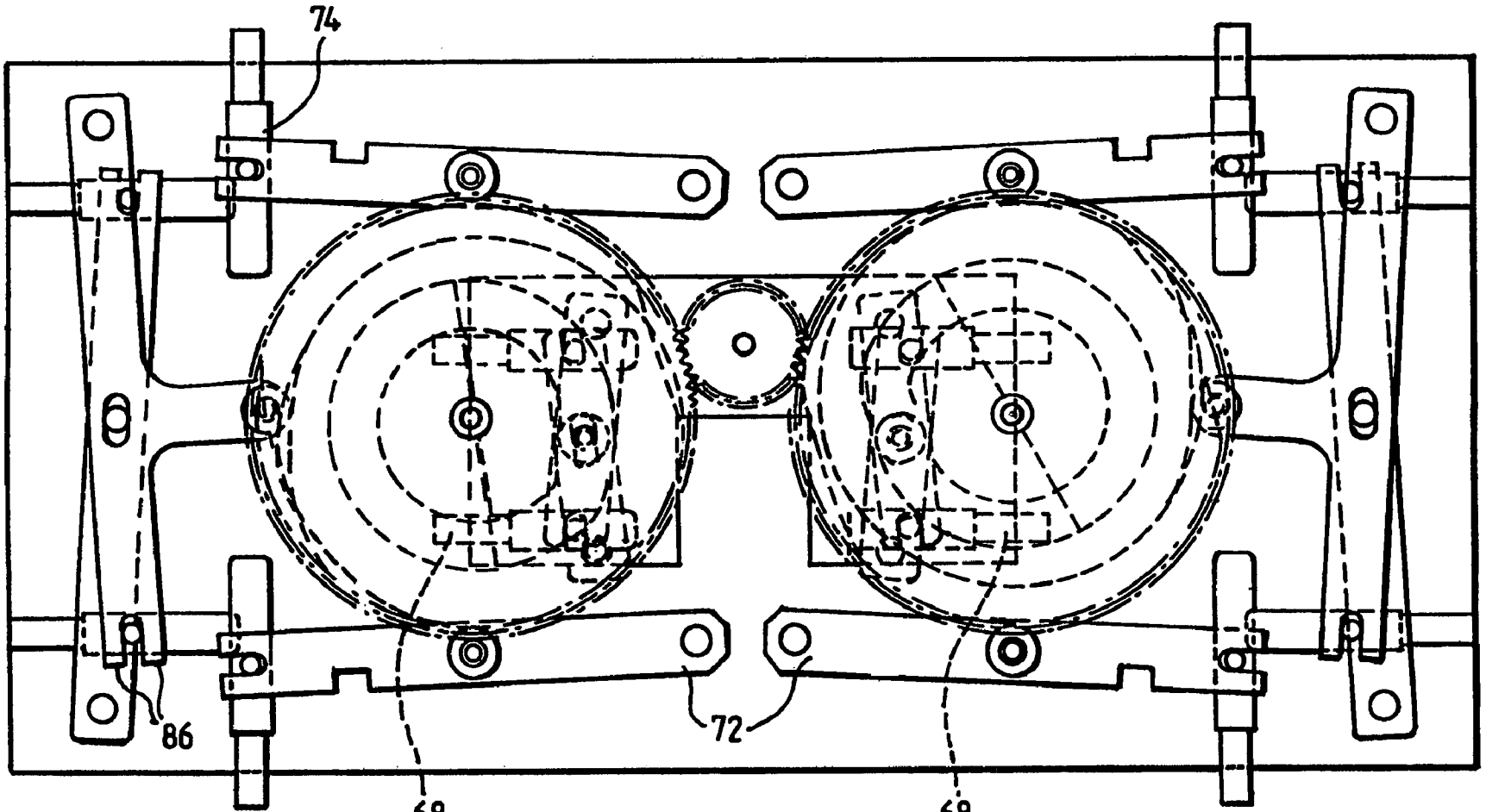
FIG. 6 illustrates the position of an interface card for locking onto the hood and cash cassette.

Starting from a position shown in FIG. 5, the operation of the interface card will now be described. Initially, the hood 8 containing the control for the interface card, including an electric motor (not shown) is placed over the interface card such that the motor in the hood engages with the input shaft 40 of the interface card. The interface card may include a solenoid 100 which is coupled to an induction coil 102. The hood 8 contains a similarly disposed induction coil and when the hood is correctly positioned, the induction coil therein couples with the coil 102 to energize the solenoid 100 thereby retracting a locking element from engagement with the gear 38. The input shaft is then rotated to extend the locking pins 74 such they engage in the recesses of the hood 8 and lock the hood to the interface card 6, as shown in FIG. 5.

Figure 7:
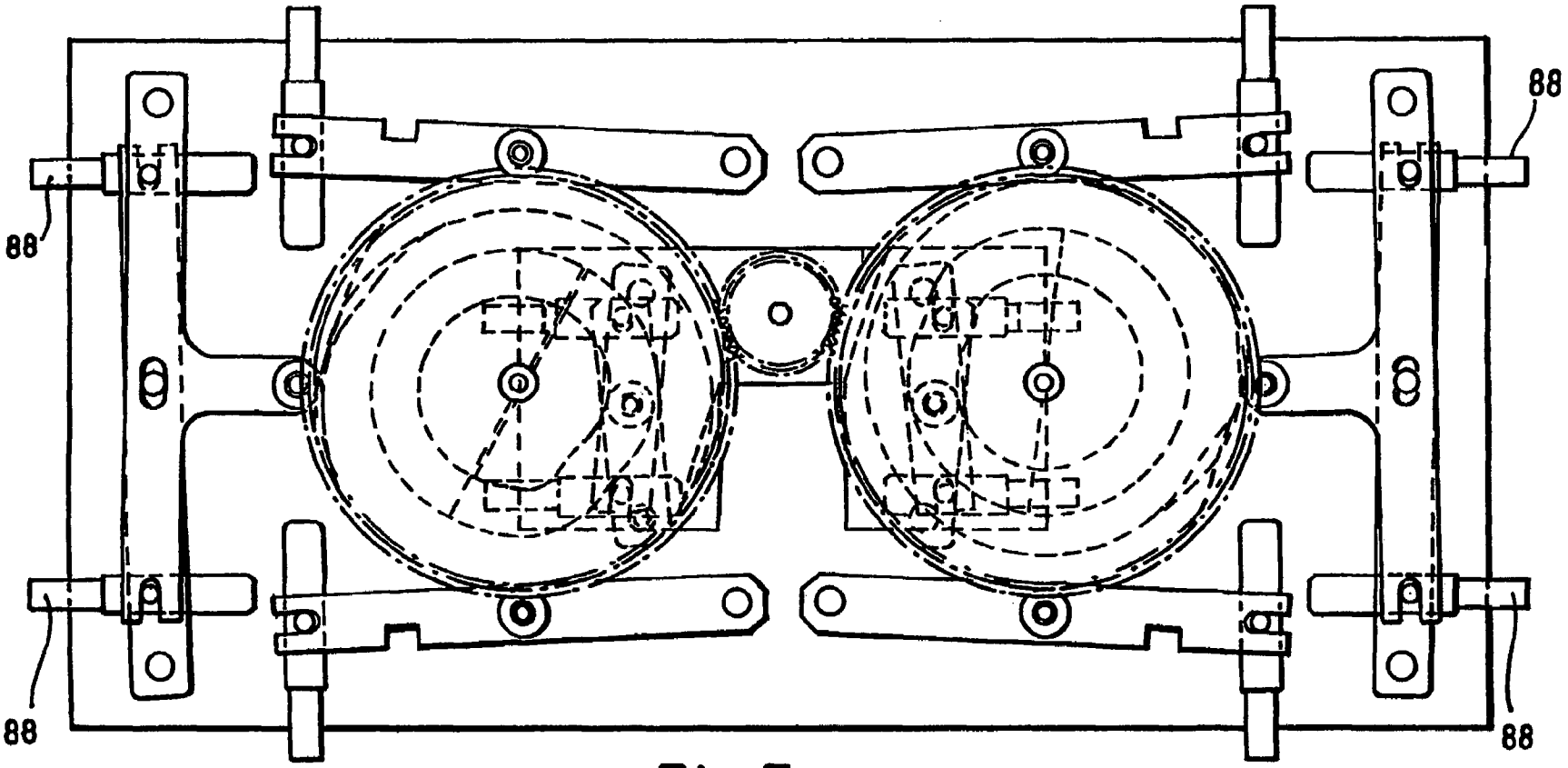
FIG. 7 illustrates the card at a position for locking onto the hood, cassette and the sleeve.
Figure 8:
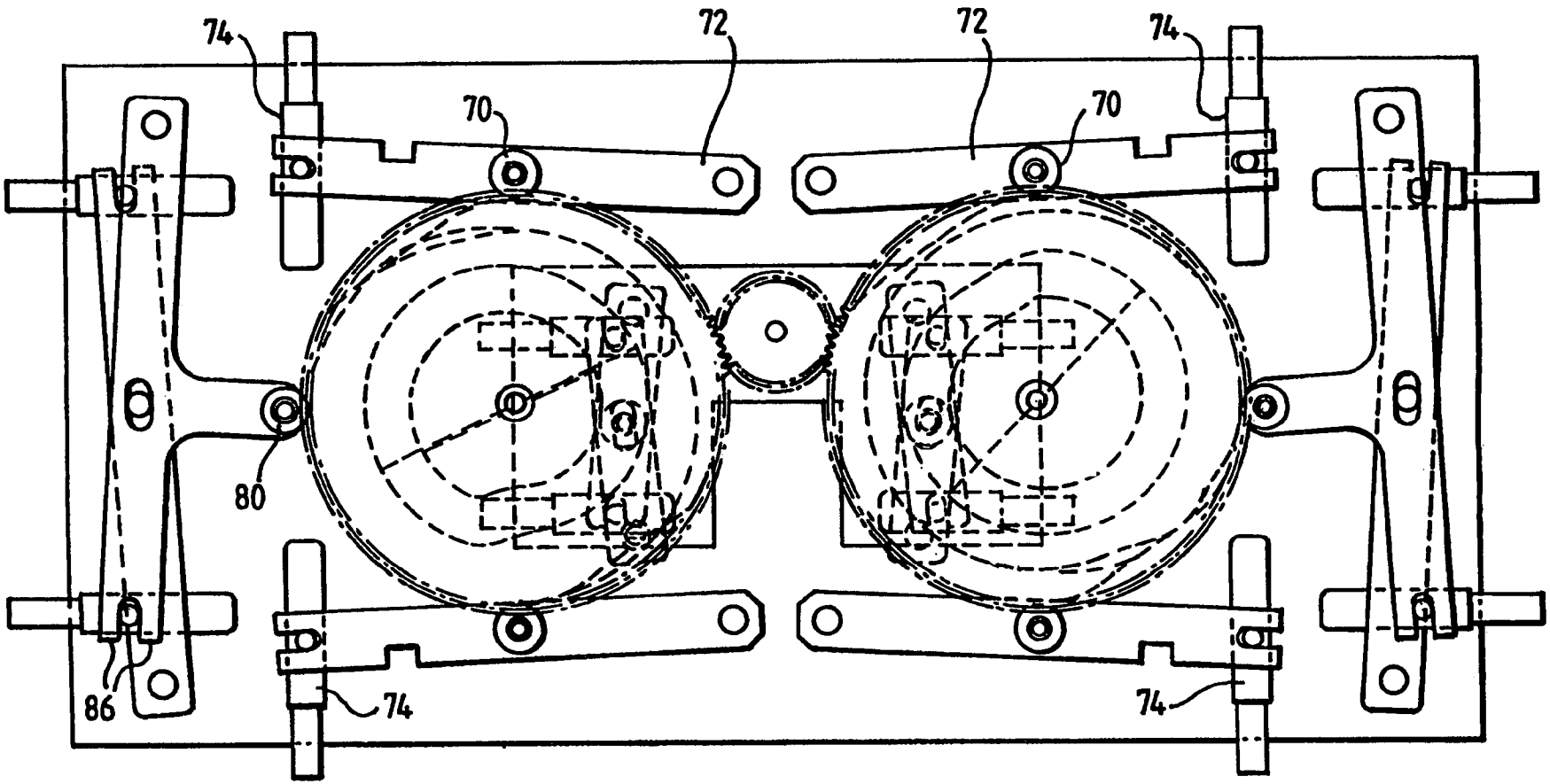
FIG. 8 illustrates the interface card at a position for locking onto the hood, cassette, sleeve and rack of a cash-in-transit vehicle.

The combined hood and interface card unit is then presented to a cash cassette 4. Once the cash cassette 4 is correctly positioned with respect to the interface card 6, the hood operates the drive motor so as to extend the pins 66 and 68, thereby locking the cash cassette onto the interface card. Next the sleeve 12 is brought into abutment with the hood 8 such that the cash cassette 4 is completely enclosed between the sleeve 12 and the hood 8. Once this has been achieved, the control electronics energises the motor again so as to drive the interface card to the position shown in FIG. 7 at which the bolts 88 are extended thereby locking the sleeve 12 to the interface card. As shown in FIG. 8, the interface card can be driven to a further position at which the bolts 88 extend further from the interface card 6 at this position, the bolts 88 protrude from the enclosure and can engage with locking recesses in a cash-in-transit vehicle storage rack. Finally, the interface card can be driven to the position shown in FIG. 9 at which the bolts 88 remain extended to engage in the storage rack but the bolts 74 have retracted in order to enable the hood 8 to be released. This final position corresponds to the mode for transport of cash within the cash-in-transit vehicle.

The rack of the cash-in-transit vehicle contains a spoiling apparatus for each cash cassette and/or a spoiling mechanism may be incorporated within the interface card.

The operational cycle for such a system is typically as follows. A cash in transit vehicle arrives at a cash centre where the ATM cassettes are loaded. The vehicle will typically include 25 to 40 sleeves 12 located on arms of a security rack. Each sleeve 12 is kept with an interface card which is locked onto both the sleeve 12 and the rack, thus the interface card is at the positioned illustrated in FIG. 9. A number of hoods, typically three (two operational hoods and one spare) are located on base stations which charge the batteries of the hoods and provide communication between the hoods and the rack controller. In order to load the vehicle, a hood is removed from its base station and presented to a sleeve/interface card in the rack. The rack arm communicates with the hood via a secure encrypted infrared communications link (seirc). As the sleeve is empty, the hood is authorised by the vehicle security system to operate the interface card firstly to move it to the position shown in FIG. 8 such that the hood becomes locked to the interface card, and then onto the position shown in FIG. 7 such that the hood and sleeve combination is released from the rack, the hood now has control of the in-transit cash container 2.

The sleeve 12, interface card 6 and hood as a combined unit are carried into the cash centre where a seirc link is provided between a control system and the hood. The control system down loads details of the destination, contents and, optionally, other information, such as encryption keys, of each cassette. The cassette may be identified by a serial number and/or bar code. Once these details are transferred to the hood, the hood is authorised to operate the interface card so as to release the sleeve 12 and then to move to a position (FIG. 5) where it is ready to lock onto the cash cassette. The hood/interface card is then presented to the cassette and the hood moves the interface card to the position shown in FIG. 6. The cassette is then inserted into the sleeve 12 and the hood moves the interface card to the position as shown in FIG. 7 so as to lock onto the sleeve.

Figure 9:
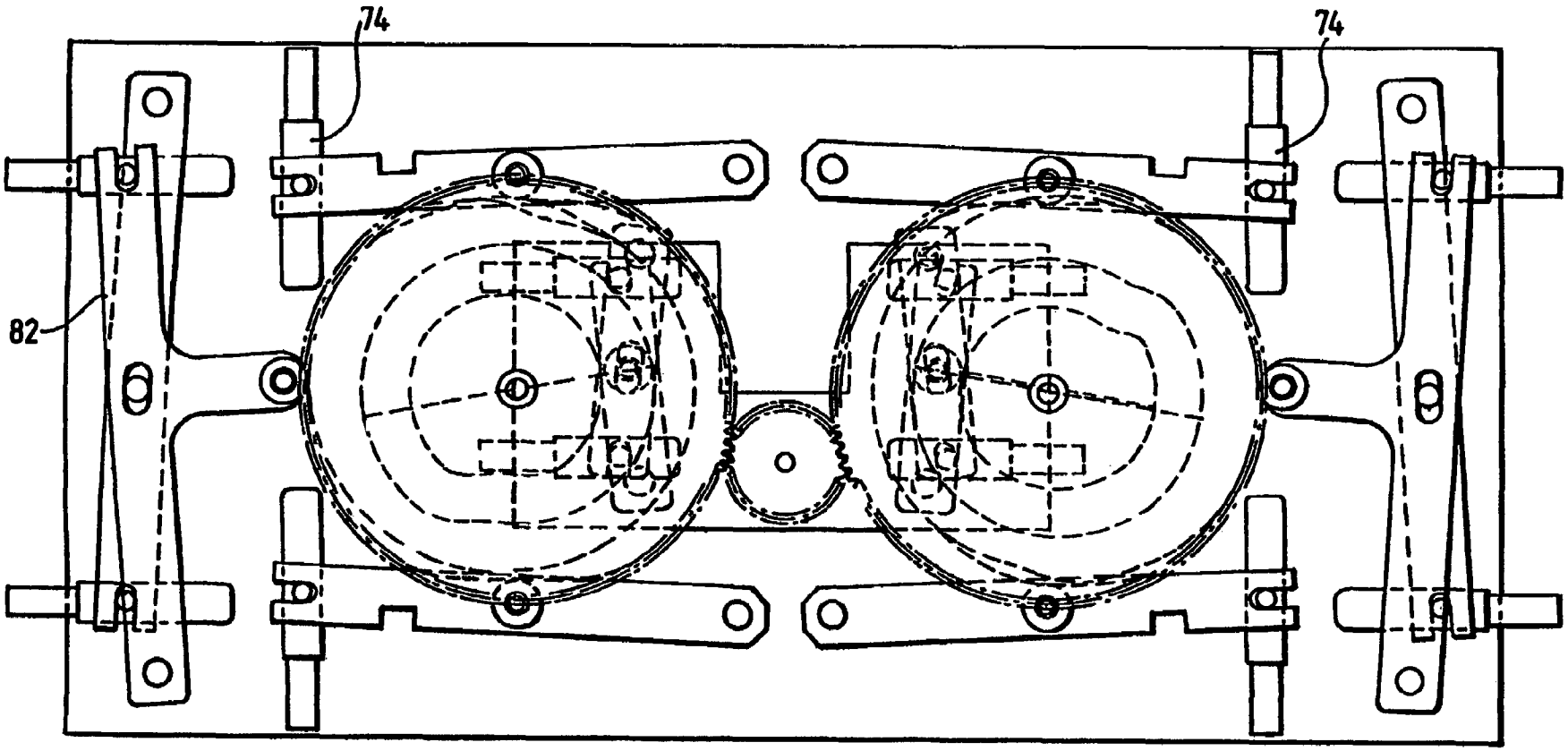
FIG. 9 illustrates the interface card at a position where it locks onto the cassette, sleeve and rack of the cash-in-transit vehicle, but has released the hood.

The combined unit is then carried onto the vehicle and is inserted into one of the empty rack arms. The hood and rack communicate by the seirc link and the hood passes the cassette details to the rack arm and security system controller. The controller authorizes the hood to move the interface card to the position shown in FIG. 8 so as to lock the interface card to the rack. Once the rack arm has confirmed that locking has been achieved, the hood is then authorised to move the interface card to the position as shown in FIG. 9 so as to release the hood. The hood is then used to load the rest of the cassettes.

The cassettes are protected on the vehicle in a number of ways. Each cassette is fully enclosed by a sleeve/interface card which both contain continuous electrical circuits which are monitored by the rack. Loss of these circuits is interpreted as a physical attack on the system and the degradation system in the rack arm will then be actuated to spoil the contents.

An attempt to remove the cassette/sleeve/interface card unit forcibly from the rack arm will be detected by the rack arm which will cause spoiling of the contents.

An attack on the rack arm itself will also be interpreted as an attack and will cause the spoiling system to be activated.

The rack as a whole is authorised to allow only a pre-set number of cassettes to be removed at once, typically two. The number of removed cassettes is continuously monitored and a violation of this parameter, preferably after a suitable warning, results in the initiation of the degradation systems in some or all the rack arms. Such selection may be based on the contents of the cassettes.

When the vehicle reaches a drop off destination, this fact is communicated to the security system and to the hoods. The information may be communicated in a number of ways and may include confirmatory information obtained by positioning devices such as GPS. Furthermore the hood is passed information by the rack appertaining to the drop off site. The information may include encrypted access control data and identification data such that the hood may establish a communications link with the ATM in order to confirm that the correct cassette is to be loaded into the correct machine. The ATM may use its communication link with its control centre in order to obtain validation that the delivery is authorised and to check the identity codes are correct.

It is usual for deliveries to be carried out by two guards because of the risk of attack at the point of replenishment. Furthermore, it is also required that the route to the ATM be checked out by doing a dummy run before the cassettes are taken across the pavement. For commercial reasons, the security procedures are often breached. However, the system has the opportunity to force that these procedures take place. Furthermore, since the cash is transported in a secure environment, the number of guards may be reduced. Once the vehicle has arrived, the vehicle's security system only authorizes a hood to mate with an empty sleeve. This is then carried by the guard from the vehicle to the ATM. The hood monitors the amount of movement (walk time and/or distance and/or path traveled) between the vehicle and its destination. This information may then be uploaded to the security system of the vehicle in order that it can be communicated to the or each other hood.

Replenishment may be made outside normal operating hours. In order to avoid use of keys, an option to the system is for the hood to communicate with a sensor located adjacent the door of the bank such that the door is unlocked upon delivery of the cash. Furthermore, the safe surrounding the ATM, and the ATM itself may also communicate with the hood in order to release their various locking mechanisms. As part of this information transfer, the hood may gain information verifying that it has been taken to the correct destination. This overcomes an attack strategy of taking the vehicle to a hidden location and inputting data to the system to indicate that it has actually arrived at its delivery point. It also prevents mistakes being made by the guard inputting the wrong location information.

In such a system as described herein above, once the guard has input the necessary location information (and any further data that is required), the hood is locked onto an empty sleeve/interface card unit. Once locking has been achieved, the hood/sleeve combination is released from the rack and is then taken to the bank, where the hood communicates with the security systems in order to gain access to the ATM. Eventually, the hood communicates with the ATM and any security systems contained therein, such as an ATM based cash spoiling system as will be described hereinafter. The security systems negotiate to enable the hood to be attached to the cassette, and once attachment is confirmed responsibility is passed from the ATM to the hood. The cassette is then released and can be withdrawn by the hood. A limited time, typically 20 seconds, is then allowed for the cassette to be inserted into an empty sleeve 12. The hood then moves the interface card to a position so as to lock onto the sleeve and the sleeve/cassette/interface card/hood is then carried back to the vehicle where it can be locked onto the rack. The removal of the first cassette from the ATM may be performed separately or as part of the dummy run. Further runs can then be made to replenish the cassettes of the ATM and remove the spent ones.

The hood may pass information to the ATM concerning the amount and denomination of notes held in the cassette. Thus the ATM can keep a running total of the amount of cash contained in it and may use this to assert a signal to a control centre to request replenishment when it begins to run unacceptably low on money. The hood can also accept data from the ATM concerning the amount of cash left in each cassette, and this can be transferred back to the cash centre for automated cash reconciliation. Fault reporting may also be performed in this manner.

Figure 10:
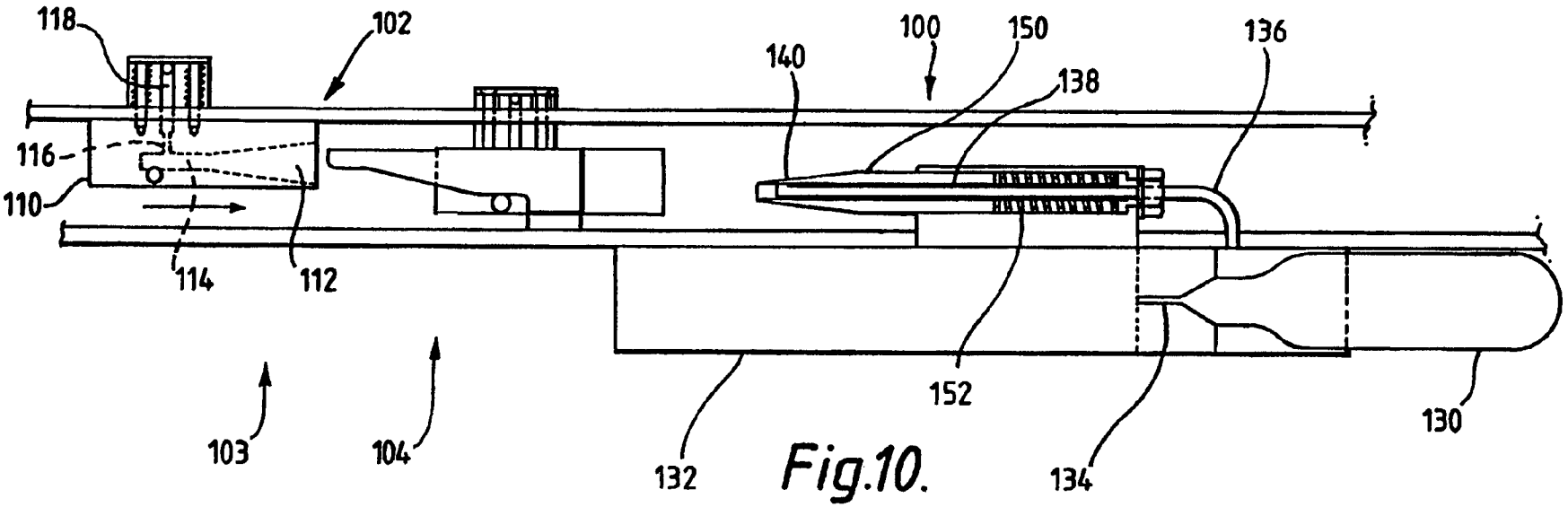
FIG. 10 schematically illustrates an example of an dye injection unit for use with an ATM cassette while it is loaded inside the ATM.
Figure 11:
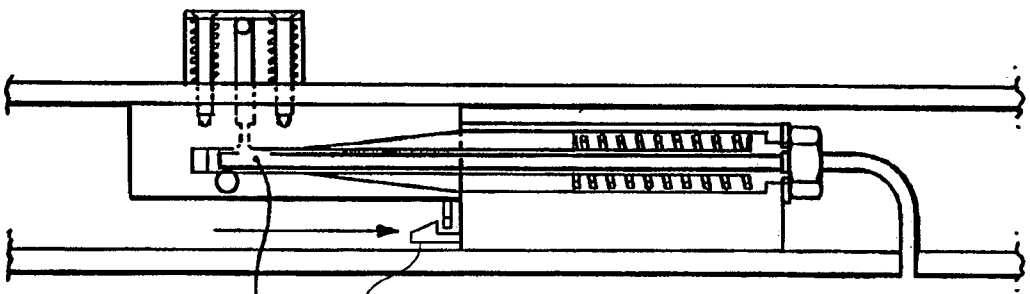
FIG. 11 illustrates the dye injection components shown in FIG. 10 at an engaged position.

In order to provide continual security for the cash once the cash cassettes are loaded into the ATM, the cassettes are modified in order to provide an ink flow passage such that ink from the exterior of the cassette can be injected into the cassette and applied to the cash therein in order to spoil it. The cassette co-operates with a ATM based security system which comprises a store of a spoiling agent, which typically is an ink reservoir, means for delivering the ink, and a control system. The ink reservoir and control system are housed within a container which advantageously has a construction similar to the sleeve 12 in that it contains embedded conductors such that an attack on the enclosure can be detected. The control electronics may also communicate with the ATM via an infrared link such that an attack on either unit may be signalled to the other and the spoiling systems initiated in each and every cash cassette. It is important to ensure that the ink delivery to the cassette cannot be defeated by tampering. FIGS. 10 and 11 schematically illustrate an ink delivery system which is tamper resistant. The ink delivery system comprises co-operating male and female parts indicated generally as 100 and 102. The female part 102 is, in the embodiment illustrated, attached to the ATM cassette. Advantageously, but not necessarily, the female part is in spring loaded attachment such that it can move between the positions illustrated generally as 103 and 104 in FIG. 10 in order to accommodate tolerances in components and also to enable the same delivery route to be used when the cassette is in the ATM and also when the cassette is being carried in the security transit container illustrated in FIG. 1.

As shown, a generally rectangular casing 110 has a tapered inlet 112 formed therein. The inlet 112 may have a generally conical profile which then merges with a cylindrical bore 114. The bore 114 is a blind bore, but has at least one ink delivery outlet 116 formed in a side wall thereof adjacent, but not at, the end of the bore 114. Only one delivery outlet is illustrated for simplicity, but a plurality of delivery outlets may be provided. They may be longitudinally and/or radially disposed with respect to each other. Furthermore, the outlets may be elongated to allow correct operation to be maintained even if some longitudinal movement/misalignment occurs. The ink delivery outlet is in fluid flow communication with a, preferably flexible, pipe 118 which extends into the interior of the cash cassette. The casing 110 also incorporates a guide pin or other suitable locking elements which provides a point of attachment to a locking device, for example in the form of an arm, carried on the male part 100. The use of multiple delivery outlets enables the ink to be delivered more rapidly.

The ink injection unit comprises a gas canister 130 coupled to an ink reservoir 132 via a throttling orifice 134. The gas canister is opened via a pyrotechnic device (not shown) which is actuated to rupture a seal of the canister 130. The interior of the ink reservoir 132 is in fluid flow connection with a delivery passage 136 which forms a central delivery pipe 138 of the male member 100. The delivery pipe 138 opens at a sideways facing aperture 140 which, in use, aligns with the ink outlet passage 116 when the male and female elements are correctly coupled together. A sleeve 150 extends around the delivery pipe 138. The sleeve 150 is slidable with respect to the delivery pipe between a first position, as illustrated in FIG. 10, in which the sleeve extends over the outlet 140, and a second position (FIG. 11) in which the sleeve slides to the right as shown in FIG. 10 in order to expose the delivery outlet 140. The sleeve is urged to first position by a compression spring 152.

In use, the male part 100 is attached to an automatic teller machine and positioned such that it engages with the female part 102 carried on a cash cassette when the cash cassette is at its operating position. As the cash cassette is loaded, the casing 110 is moved towards the male part 100 and the sleeve 150 engages with the conical recess 112 and is pushed against the urging of the compression spring 150 to uncover the aperture 140. This relative motion also ensures than any debris in the aperture 112 is pushed past the outlet pipe 116 thereby ensuring that debris cannot be deliberately introduced into the aperture 112 in order to defeat the security systems. A position sensor (not shown) monitors the relative motion of the sleeve 150 with respect to the remainder of the male unit to ensure that it reaches the correct position. Additionally, a latching arm 142 extends from the male unit towards a matching element on the female unit. The latching arm can only engage if the male and female units are correctly positioned with respect to one another. The position of the latching arm and also of the sleeve 150 is monitored by a controller (not shown) and only when these are at their correct position does the controller acknowledge that the security system is operable. The locating elements may be arranged to lock the cash cassette at a first position corresponding to the operating position of the cassette in the ATM. However, the locking elements may include sacrificial or weakened elements which, in the event that an unauthorised attempt is made to forcibly remove the cash cassette, allows the cassette to be moved to a second, slightly withdrawn position, which is detected by a position sensor. This movement to the second position causes the ink delivery system to be activated so as to spoil the contents of the cassette. The provision of multiple delivery outlets, or an elongate outlet, ensures that the ink delivery system can still work when the cassette is at the second position.

FIG. 11 shows the details of the coupling between the male and female unit when properly coupled in greater detail.

Figure 12A:
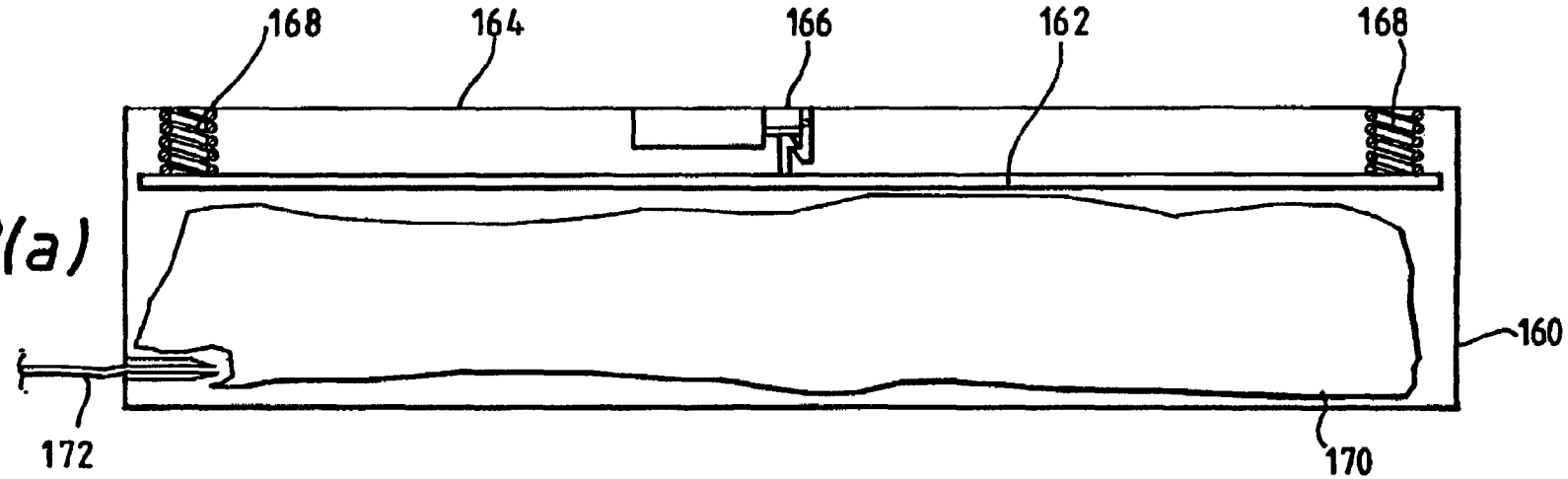
FIGS. 12*a* and 12*b* schematically illustrate the operation of a mechanically powered dye injection system.
Figure 12B:
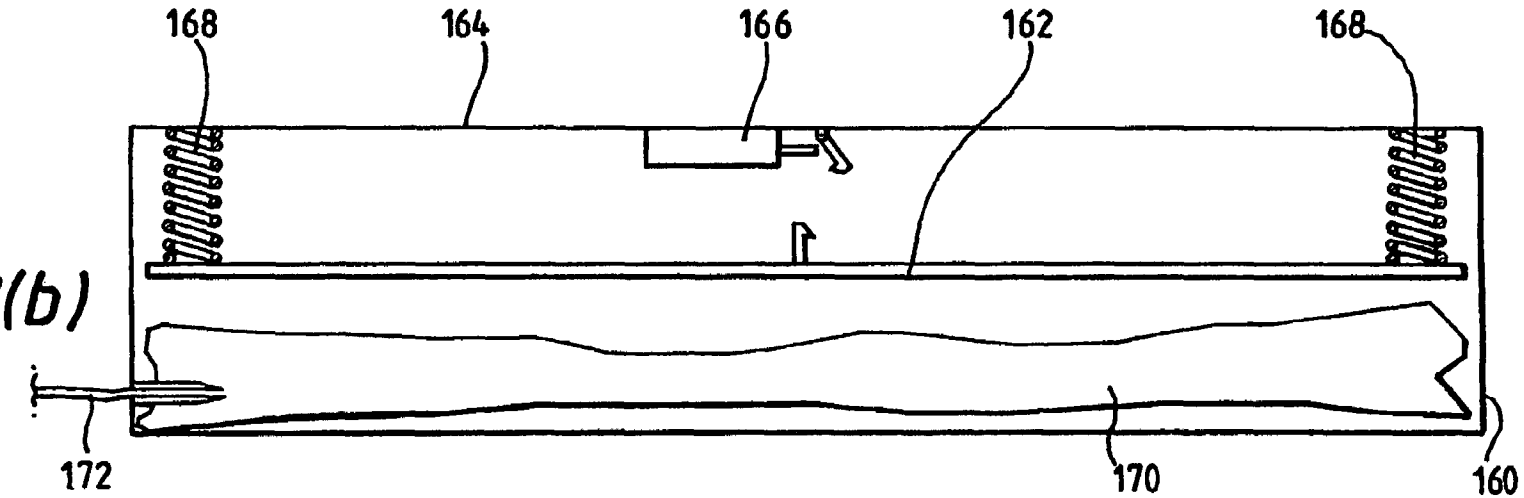

Other ink release schemes may also be used as an alternative to use of compressed gas in a cylinder. FIGS. 12*a* and 12*b* schematically illustrate a mechanically based scheme in which an enclosure 160 contains a plate 162 which is held adjacent a wall 164 of the enclosure by a mechanical lock mechanism 166. Compression springs 168 act around the periphery of the plate 162 in order to urge it away from the wall 164. A flexible reservoir 170 of ink is positioned in the enclosure 160 such that it becomes compressed by the action of the plate 162 and springs 168 when the mechanical lock mechanism 166 is released. A needle 172 extends into the container 160 and is positioned such that the ink reservoir is compressed against the needle 172 when the lock mechanism 166 is released, thereby causing the needle 172 to puncture the flexible reservoir 170 and to provide an escape route from the ink reservoir.

The ink may contain additives, or itself be selected, such that it exhibits optical properties such as absorption or reflection outside of the visible range of light such that it can be detected by automated security systems. Additionally or alternatively the ink may fluoresce or phosphoresce.

The system can also cope with multi-part ink or degradation agents. Thus, in a two component system, a first reservoir containing a first component is separated from a second reservoir containing a second component. The first reservoir is arranged to receive compressed gas from a canister as described with reference to FIG. 10. The first reservoir is separated from the second reservoir by an element which opens to allow fluid flow to the second reservoir once the pressure in the first reservoir exceeds a predetermined threshold. Similarly the second reservoir opens to expel its contents once the pressure therein exceeds a predetermined threshold. The opening of the reservoirs may be performed by a frangible membrane or a pressure operated valve. Thus, an actuation of the gas canister, pressure in the first reservoir increases until such time as the connection to the second reservoir opens. The contents of the first reservoir can then flow into the second, increasing the pressure therein. As a consequence the outlet of the second reservoir opens, thereby allowing the first and second components of the ink to react and both to be expelled into the cassette.

Figure 13:
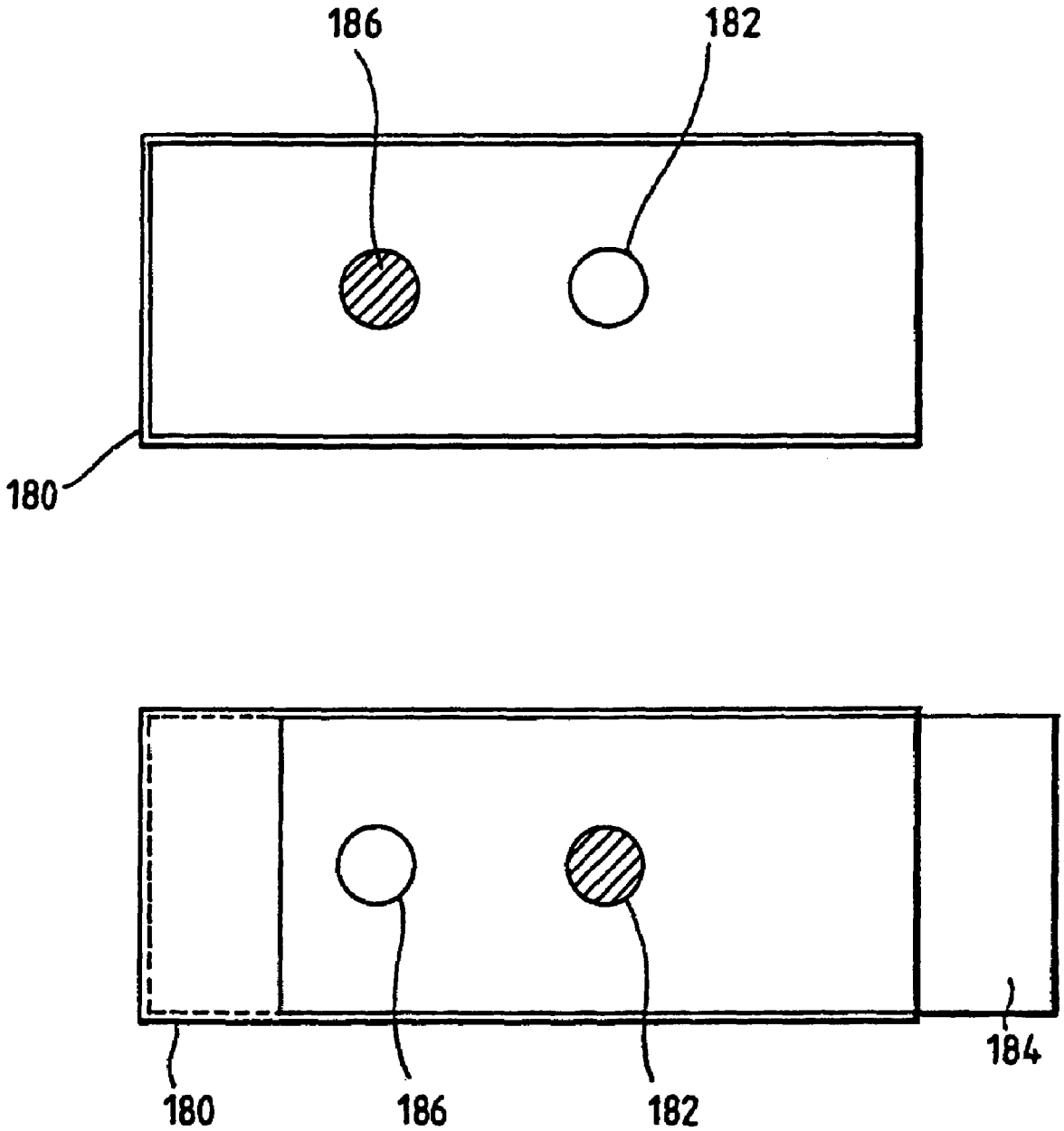
FIG. 13 schematically illustrates a sleeve security system whereby removal of the sleeve when the system is active cause the dye injectin system to become activated via an inductive coupling.

In addition to the security system described herein above it may be advantageous to also include a simple relative motion based system whereby movement of one item, for example an ATM cassette, with respect to another item, for example a sleeve, causes a spoiling system to be deployed. FIG. 13 schematically illustrates such a system. FIG. 13 schematically illustrates a sleeve 180 carrying a first induction coil 182, and cassette 184 carrying a second induction coil 186. The induction coil 186 is connected to a spoiling mechanism. The induction coil 182 is connected to a security system, and is energised, for example with alternating current when the security system is operative. If an attempt is made to remove the cassette 184 from the sleeve 180, the second induction coil 186 slides towards and eventually becomes aligned with the first induction coil 182. This enables the coils to inductively couple, thereby providing power to the degradation/spoiling mechanism contained within the cassette 184 which then activates.

Figure 14:
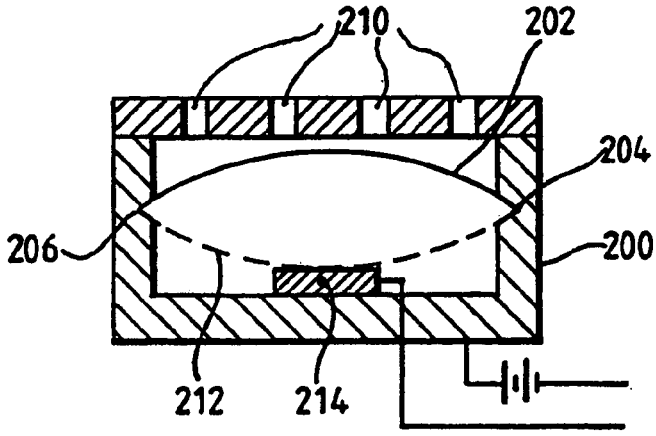
FIG. 14 schematically illustrates a blast detector constituting an embodiment of the present invention.

FIG. 14 illustrates a blast detection device which can be used to monitor when an explosion is used to attempt to overcome the security measures of a cash cassette or ATM.

The device comprises a housing 200 which encloses a planar element 202 held in a compressed state between first and second supports 204 and 206, respectively. The element 202 is, by virtue of the compression, held in a bowed state. The housing 200 also has apertures 210 formed therein such that pressure waves from an explosion can impinge on a first side (the side facing the apertures). The pressure wave causes the element 202 to spring to a second bowed state, as represented by the chain line 212. Such motion can be detected, for example by the provision of a micro-switch or by putting a terminal 214 in a position such that the element 202 abuts it. The element 202 may be conducting such that, in this position, it completes a circuit involving the terminal 214. Alternatively two terminals (not shown) may be provided. The circuit may be directly connected to a detonation device of the spoiling system.

Figure 15:
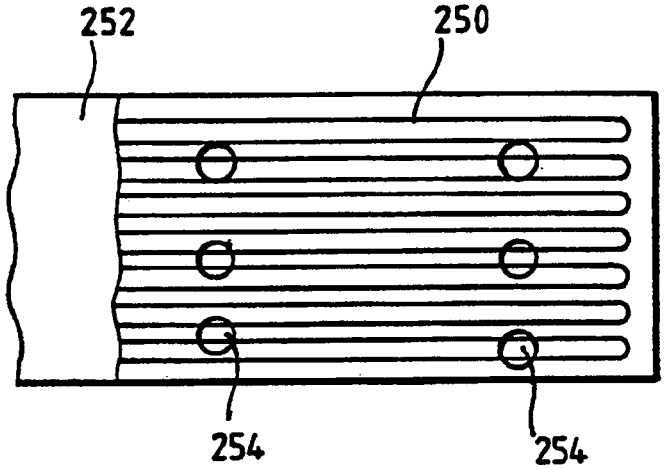
FIG. 15 illustrates an embodiment of the sensing array within a tamper resistant element.

The cabinet surrounding the ATM may also be constructed in a manner that allows blast detection to be performed. A sensor element may be embedded within the cabinet. As shown in FIG. 15, the sensor element comprises a conduction 250 arranged as a plurality of parallel, closely spaced conducting paths, in series with one another.

The conductor 250 is supported on a substrate 252 which is typically a flexible plastics. A further layer of plastics (not shown) may be provided such that the conductor 250 is sandwiched between the plastics layers.

Holes 254 are provided in the plastics layer(s) 252 such that the portion of conductor 250 overlying a hole 254 is unsupported. The cabinet is arranged such that holes are formed therein corresponding to the positions of the holes 254. As a consequence a pressure wave resulting from an explosion can damage the conductive portions in the vicinity of a hole 254, thereby causing the conductor to become "open circuit" and signalling that a blast has occurred.

Figure 16:
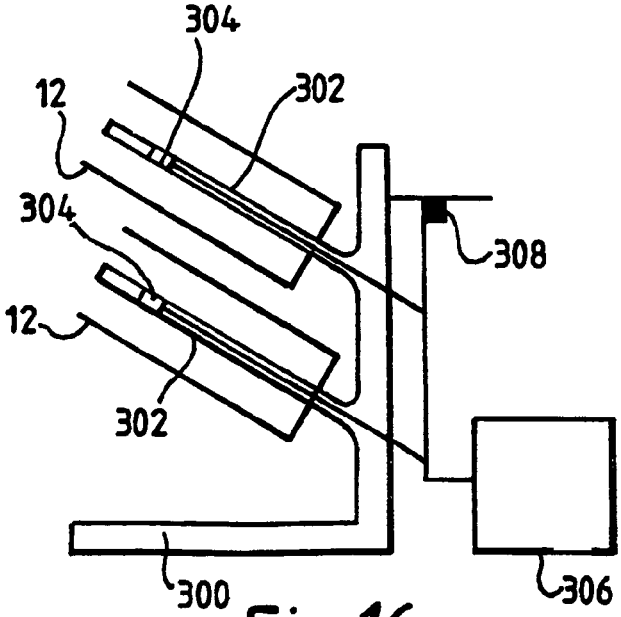
FIG. 16 schematically illustrates the rack system of the cash in transit vehicle.

The rack system of a cash in transit vehicle is schematically illustrated in FIG. 16. The rack 300 has arms 302 extending therefrom which either engage with grooves formed in the wall of the enclosures 12 (as described with respect to FIG. 1) or which have enclosure supporting trays attached thereto. The arms are arranged in laterally spaced apart pairs so that one is provided either side of the enclosure 12. Each arm 302 includes a communications link 304 connected to a central data controller 306. The communications link 304 enables bi-directional communication to be established with the internal module 10 of a hood 8 when the hood is delivered up to the end of the enclosure 12. This ensures that the hood must be brought up to the correct enclosure and this must be verified by the control unit 306 before the hood and internal module 10 is given permission to operate the interface card 6 in order to retract its engagement elements such that the interface card disengages from receiving apertures in the rack. The data controller 306 also communicates via a further communications element 308 with a docking station to which a hood 8 (incorporated the control element 10) must be positioned for programming prior to being released from the vehicle.

Figure 17:
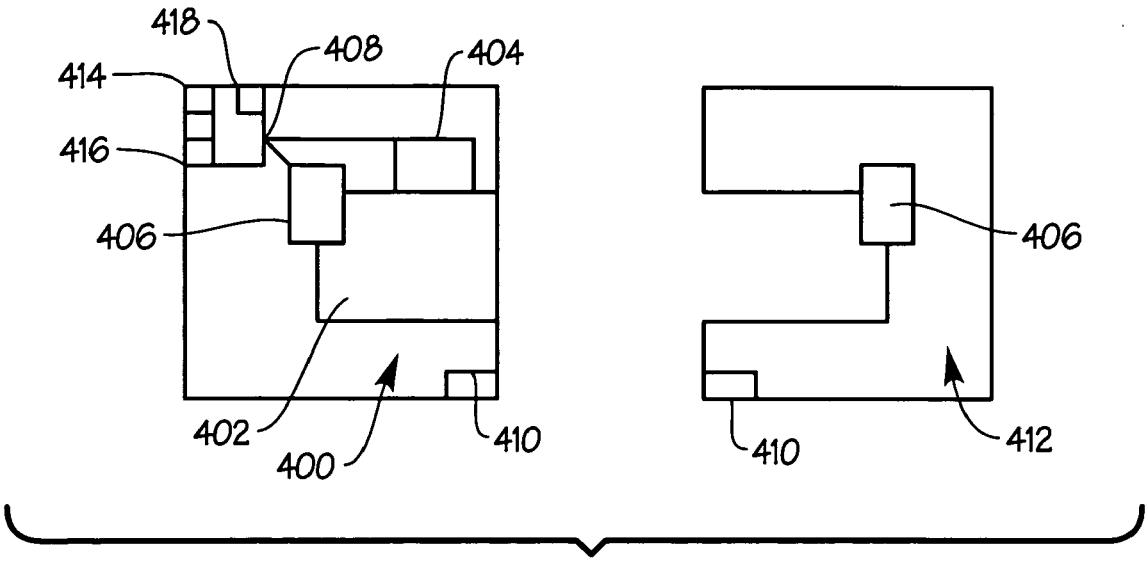
FIG. 17 is a schematic drawing showing first and second security systems with the portable container, spoiling means and control means.

FIG. 17 shows a schematic representation of an embodiment of the invention which includes a first security system 400 holding a portable container 402. The first security system includes a locking means 406 to retain the portable container 402 and a spoiling means 404 to spoil the contents of the portable container if the container or system is tampered with. Control means 408 within the first security system, which controls the operation of both the locking means 406 and the spoiling means 404, includes a local memory 414, a power supply 416 and one or more sensors 418 to detect inappropriate movements of the container or attempts to defeat the security system. Examples of the sensors 418 include an accelerometer, compass, inertial guidance system or temperature sensor. The temperature sensor would have the capability to detect extreme heat, such as from a hot torch, or extreme cold, which might be used to interfere with operation of the security system elements. Also shown is a second security system 412 designed to receive the portable container 402 from the first security system and communication means 410 for exchanging data between the two security systems to validate that the second security systems has control of the container before the first system relinquishes control.

It is thus possible to provide a security system suited for use in cash-in-transit and ATM operations. Furthermore, such a security system also simplifies maintenance of an automatic teller machine. Hitherto, it has been necessary to arrange for security guards and a cash-in-transit vehicle to come and collect the cassettes from an ATM before it can be serviced since opening the safe of the ATM in order to service it has posed a security risk. However, with the use of a dye based spoiling system as part of the ATM, cassettes may remain in the ATM and be protected by the security system during servicing. In the event that it is necessary to remove a cassette, the cassette may be placed in a sleeve and hood combination as described herein before. Such a hood may be a service hood specially programmed to allow only a very minimal walk time in order to ensure that the cassette cannot be moved far from the ATM, or may include a proximity based communication system to the ATM again to ensure that the cassette cannot be removed far from the ATM without triggering the spoiling mechanism.

Furthermore, the enhanced security systems provided within an ATM may enable the heavy steel safe that normally surrounds an ATM to be replaced by a lighter safe made of similar materials to the sleeve 12 as herein before described.

The invention claimed is:

1. A cash transit container security system for attaching to a cash cassette and for enabling a delivery person to transport the cash cassette to an automated teller machine (ATM), the system comprising:

a locking mechanism engaging with an exterior of the cash cassette when properly locked onto the cash cassette to be protected, the locking mechanism engaging with the exterior of the cash cassette preventing contents of the cash cassette from being accessed during transportation of the cash cassette to the ATM by the delivery person;

an activatable spoiling mechanism for, when properly positioned and activated, spoiling the contents of the cash cassette; and a control module for (i) controlling activation of the spoiling mechanism, (ii) sending a first signal to the ATM to indicate that the locking mechanism is properly locked onto the cash cassette and the spoiling mechanism is properly positioned for, when activated, spoiling the contents of the cash cassette, (iii) after the first signal has been sent to the ATM, receiving a second signal from the ATM indicating that the ATM has taken over responsibility for protecting the contents of the cash cassette, and (iv) controlling the locking mechanism to unlock from the cash cassette in response to receiving the second signal from the ATM, and thereby to allow the delivery person to remove the transportable cash transit container security system from the cash cassette after the cash cassette has been transported to the ATM.

2. A transportable cash transit container security system according to claim 1, wherein the control module communicates with the ATM to validate identities and to exchange data concerning any of a value and a denomination of money being transferred.

3. A cash transit container security system according to claim 1, wherein the locking mechanism comprises a latch which allows movement of the cash cassette from a first position to a second position such that movement of the cash cassette from the first position to the second position results in activation of the spoiling mechanism to spoil the contents of the cash cassette.

4. A transportable cash transit container security system according to claim 3, wherein the locking mechanism comprises a plurality of engagement elements moveable between locked and unlocked positions.

5. A transportable cash transit container security system according to claim 4, wherein the engagement elements comprise slidable bolts.

6. A transportable cash transit container security system according to claim 5, further comprising an enclosure having an opening for accepting the cash cassette.

7. A transportable cash transit container security system according to claim 6, wherein the engagement elements are sequentially actuatable upon input from the control module to sequentially lock onto parts as follows:

(i) lock onto the control module;

(ii) lock onto the control module and the cash cassette;

(iii) lock onto the control module, the cash cassette, and the enclosure.

8. A transportable cash transit container security system according to claim 1, wherein the control module measures at least one of walk time, distance traveled, and absolute time since last release of the cash cassette, and activates the spoiling mechanism if any of the measurements exceeds a preset threshold.

9. A cash transit container security system according to claim 1, wherein the locking mechanism engages with a removable closure sealing an opening in the exterior of the cash cassette to thereby lock the removable closure and seal the cash cassette.

10. A transportable cash transit container security system for attaching to a cash cassette and for enabling a delivery person to transport the cash cassette, the system comprising:

a locking mechanism engaging with an exterior of the cash cassette when properly locked onto the cash cassette to be protected, the locking mechanism engaging with the exterior of the cash cassette to prevent contents of the cash cassette from being accessed during transportation of the cash cassette by the delivery person;

an activatable spoiling mechanism for, when properly positioned and activated, spoiling the contents of the cash cassette; and a control module for (i) controlling activation of the spoiling mechanism, (ii) receiving a first signal allowing the locking mechanism to lock onto the cash cassette, and (iii) after the first signal has been received, sending a second signal to indicate that the locking mechanism is properly locked onto the cash cassette and the spoiling mechanism is properly positioned for, when activated, spoiling the contents of the cash cassette, and thereby to indicate that the contents of the cash cassette are being protected and that the cash cassette is ready to be transported by the delivery person, wherein the locking mechanism comprises a latch which allows movement of the cash cassette from a first position to a second position such that movement of the cash cassette from the first position to the second position results in activation of the spoiling mechanism to spoil the contents of the cash cassette.

11. A transportable cash transit container security system according to claim 10, wherein the locking mechanism comprises a plurality of engagement elements moveable between locked and unlocked positions.

12. A transportable cash transit container security system according to claim 11, wherein the engagement elements comprise slidable bolts.

13. A transportable cash transit container security system according to claim 12, further comprising an enclosure having an opening for accepting the cash cassette.

14. A transportable cash transit container security system according to claim 13, wherein the engagement elements are sequentially actuatable upon input from the control module to sequentially lock onto parts as follows:

(i) lock onto the control module;

(ii) lock onto the control module and the cash cassette;

(iii) lock onto the control module, the cash cassette, and the enclosure.

15. A transportable cash transit container security system according to claim 10, wherein the control module measures at least one of walk time, distance traveled, and absolute time since last release of the cash cassette, and activates the spoiling mechanism if any of the measurements exceeds a preset threshold.

16. A transportable cash transit container security system according to claim 10, wherein the control module communicates with an ATM to validate identities and to exchange data concerning any of a value and a denomination of money being transferred.

17. A method of operating a transportable cash transit container security system to enable a delivery person to transport a cash cassette to an automated teller machine (ATM), the method comprising:

sending a first signal to the ATM to indicate that a locking mechanism is properly locked onto the cash cassette and an activatable spoiling mechanism is properly positioned for, when activated, spoiling the contents of the cash cassette;

after the first signal has been sent to the ATM, receiving a second signal from the ATM indicating that the ATM has taken over responsibility for protecting the contents of the cash cassette; and in response to receiving the second signal from the ATM, controlling the locking mechanism to unlock from the cash cassette and thereby to allow the delivery person to remove the transportable cash transit container security system from the cash cassette after the cash cassette has been transported to the ATM.

18. A method according to claim 17, further comprising communicating with the ATM to validate identities and to exchange data concerning any of a value and a denomination of money being transferred.

* * * * *